United States Patent [19]

Watanabe

[11] Patent Number: 4,498,665

[45] Date of Patent: Feb. 12, 1985

[54] PAPER SORTING/STORING APPARATUS

[75] Inventor: Junji Watanabe, Yokohama, Japan

[73] Assignee: Tokyo Shibaura Denki Kabushiki Kaisha, Kawasaki, Japan

[21] Appl. No.: 478,640

[22] Filed: Mar. 24, 1983

[30] Foreign Application Priority Data

Apr. 16, 1982 [JP] Japan ..... 57-63661

[51] Int. Cl.[3] ..... B65H 39/11

[52] U.S. Cl. ..... 271/289; 271/296; 271/303

[58] Field of Search ..... 271/289, 290, 288, 296, 271/297, DIG. 9, 302, 303, 304; 270/58; 198/367, 577, 442

[56] References Cited

U.S. PATENT DOCUMENTS 3,561,753 2/1968 Snellman ..... 271/296

FOREIGN PATENT DOCUMENTS 2551748 6/1976 Fed. Rep. of Germany .
2631115 2/1977 Fed. Rep. of Germany .
2733521 2/1978 Fed. Rep. of Germany .
3036648 4/1981 Fed. Rep. of Germany .
3036719 10/1981 Fed. Rep. of Germany .
35702 8/1978 Japan ..... 271/298

*Primary Examiner*—Duane A. Reger
*Assistant Examiner*—Alvin Oberley
*Attorney, Agent, or Firm*—Cushman, Darby & Cushman

[57] ABSTRACT

A sorter is provided, which has: a transfer direction switching section for selectively switching a transfer direction of a conveyed paper sheet between first or second transfer directions; a first paper transfer section for transferring the paper sheet in the first transfer direction selected by the transfer direction switching section; a second paper transfer section for transferring the paper sheet in the second transfer direction selected by the transfer direction switching section; a nonsort/storage section for sorting and storing the paper sheet transferred by the first paper transfer section; a sort/storage section for sorting and storing the paper sheet transferred by the second paper transfer section; and a paper transfer/drive section for interrupting the second paper transfer section so as to perform nonsort/storage operation by driving only the first paper transfer section when the paper sheet to be sorted is jammed.

3 Claims, 17 Drawing Figures

PAPER SORTING/STORING APPARATUS

BACKGROUND OF THE INVENTION

The present invention relates to a paper sorting/storing apparatus for sorting copied paper sheets in accordance with the required number of document sets when various types of documents are multi-copied by a copying machine.

In a conventional paper sorting/storing apparatus of the type described above, the copied paper sheets which are sequentially discharged from the discharge section of the copying machine are sorted into bins of a sorting/storing section in accordance with the number of document sets. In this manner, the various multicopied sheets can be sorted in accordance with the number of document sets. When storing the copied paper sheets without sorting (nonsorting/storing operation), the copied paper sheets are sequentially stored in a specific bin or a discharge tray.

In this case, a transfer section for transferring the copied paper sheets to be sorted and stored and another transfer section for transferring the copied paper sheets which are not to be sorted are simultaneously driven by power from the copying machine main body. The selection of transfer sections to which the copied paper sheets are to be conveyed is performed by a selection gate. When jamming occurs in the transfer section for conveying the copied paper sheets to be sorted, that is, the sorting/storing section, the two transfer sections must both be stopped in order to prevent secondary paper jamming and damage to the apparatus. Therefore, the nonsorting/storing operation cannot be performed either, and hence no copying operation an be performed. When there is an urgent copying requirement, the conventional sorting/storing apparatus cannot satisfy such a requirement.

SUMMARY OF THE INVENTION

It is an object of the present invention to provide a paper sorting/storing apparatus wherein copied paper sheets sequentially transferred can be stored in the nonsorting mode even if a copied paper sheet to be sorted is jammed, thereby contributing to the efficiency of sorting.

In order to achieve the above object of the present invention, there is provided a paper sorting/storing apparatus, comprising:

transfer direction selecting means for selectively switching a transfer direction of a paper sheet between first and second transfer directions;

first paper transferring means for transferring the paper sheet in the first transfer direction selected by said transfer direction selecting means;

second paper transferring means for transferring the paper sheet in the second transfer direction selected by said transfer direction selecting means;

nonsorting/storing means for storing the paper sheet transferred by said first paper transferring means;

sorting/storing means for sorting and storing the paper sheet transferred by said second paper transferring means; and paper transferring/driving means for stopping at least said second paper transferring means while said first paper transferring means is operative, said paper transferring/driving means including, (a) a reversible drive source, (b) a first one-way clutch section for transmitting a rotational force of said drive source in one direction to said first paper transferring means; and (c) a second one-way clutch section for transmitting the rotational force of said drive source in the other direction to said second paper transferring means.

BRIEF DESCRIPTION OF THE DRAWINGS

Other objects and features of the present invention will be apparent from the following description taken in connection with the accompanying drawings, in which.

DETAILED DESCRIPTION OF THE PREFERRED EMBODIMENT

A paper sheet is copied by a copying machine main body 2 and is conveyed to a paper sorting/storing apparatus (hereinafter referred to as a sorter) 1 shown in FIG. 1 through a discharge section 3 of the copying machine main body 2. The sorter 1 stores a copied paper sheet in a sorting/storing section or in a nonsorting/storing section. The former storage operation is also called a "sort" mode, whereas the latter storage operation is also called a "nonsort" mode.

Figure 1:
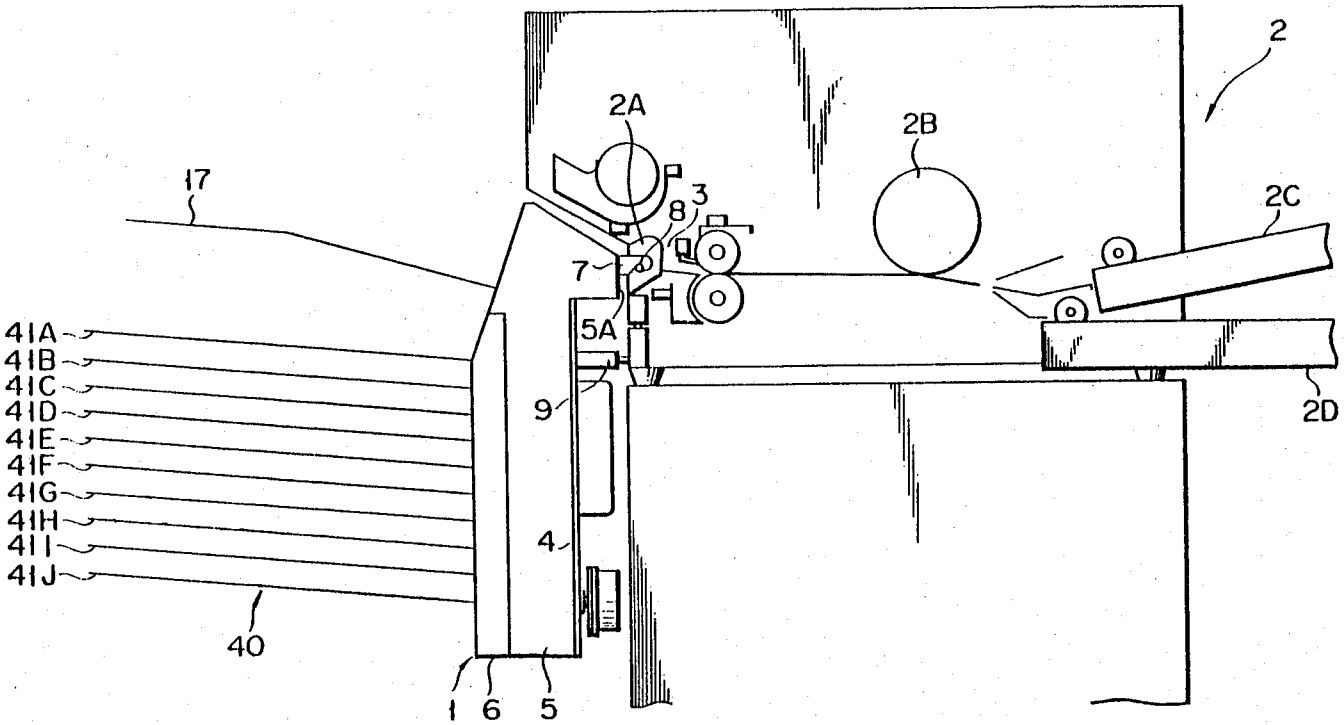
FIG. 1 is a schematic view showing the mounted condition of a paper sorting/storing apparatus according to an embodiment of the present invention.

As shown in FIG. 1, the frame assembly of the sorter 1 comprises a base plate 4, a side frame 5 and a frame cover 6. The side frame 5 which comprises a wall plate is mounted on the base plate 4. The frame cover 6 is mounted on the side frame to oppose the base plate 4. The frame cover 6 is arranged so that it may be freely opened/closed. An opening portion 5A is formed in the side frame 5 to communicate with the discharge section 3 of the copying machine main body 2. The opening portion 5A extends outward from the plate surface of the base plate 4. A pair of first engaging portions such as a pair of hooks 7 are disposed above the center of gravity of the sorter 1 (i.e., on the side frame 5 in the vicinity of the opening portion 5A), as shown in FIG. 1. A second pair of engaging portions such as a pair of studs 8 which can be respectively engaged with the pair of hooks 7 are disposed on a side frame 2A of the copying machine main body 2 in the vicinity of the paper discharge section 3. When the sorter 1 is mounted such that its hooks 7 respectively engage with the studs 8, a moment is produced by its own weight in the counterclockwise direction in FIG. 1. A foot 9 is then mountd on the base plate 4 so as to damp the moment. The distal end of the foot 9 is brought into contact with the side frame 2A of the copying machine main body 2. Note that reference numeral 2B denotes a photosensitive drum, and that reference numerals 2C and 2D denote paper feed cassettes.

Figure 2:
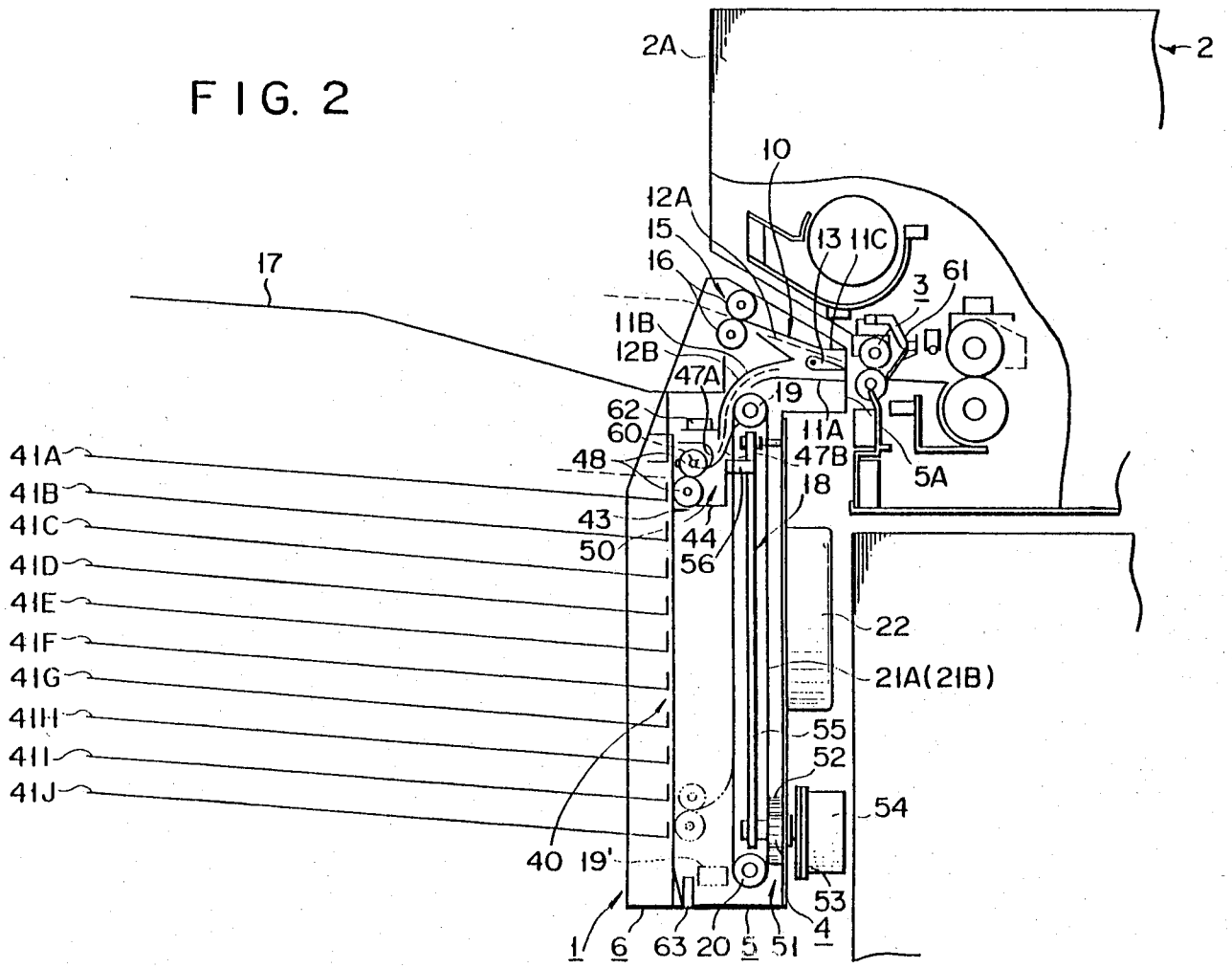
FIG. 2 is a sectional view of the apparatus shown in FIG. 1.
Figure 3:
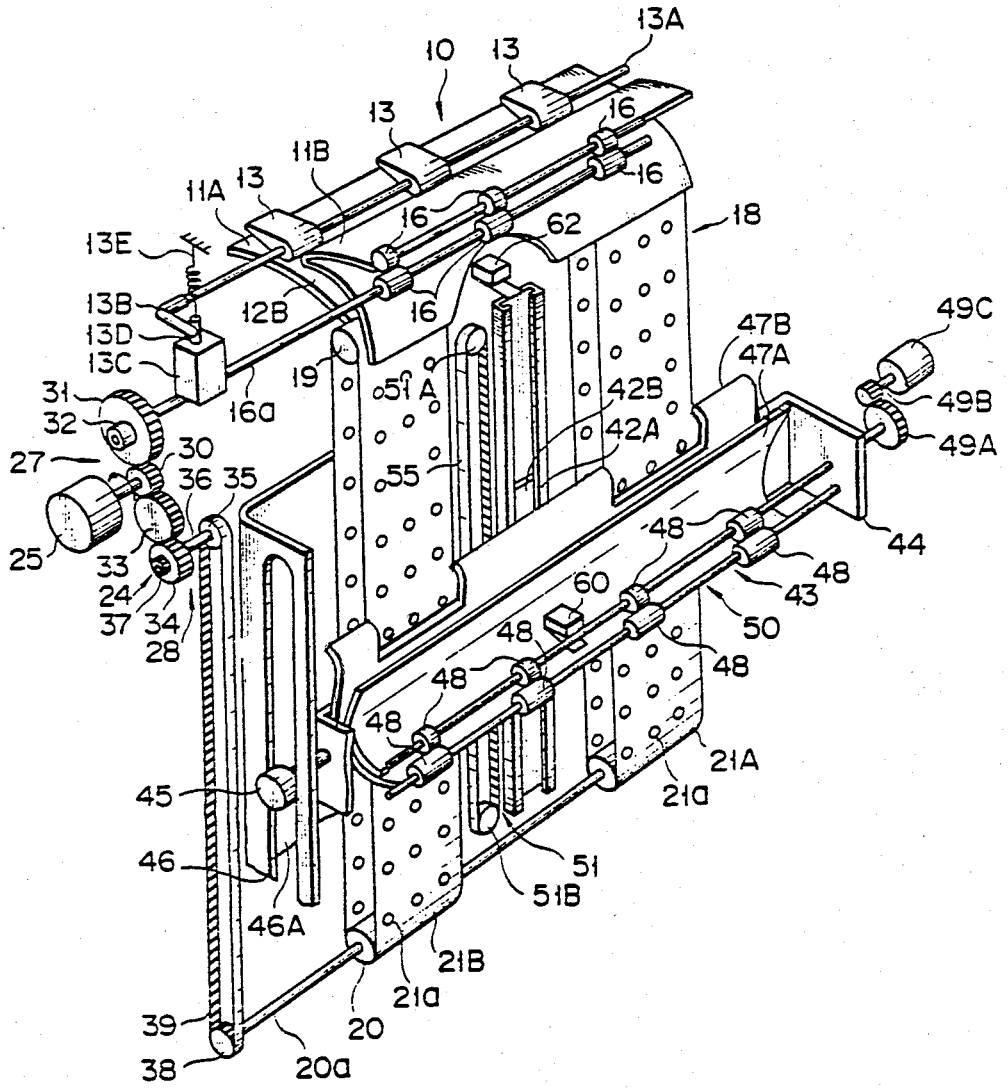
FIG. 3 is a schematic perspective view of the apparatus shown in FIG. 1.

As shown in FIG. 2, a transfer direction selector section 10 is disposed on the side frame 5 so as to vary the transfer direction of the paper sheet transferred from the discharge section 3 of the copying machine main body 2 through the opening portion 5A. In the transfer direction selector section 10, a first transfer path 12A and a second transfer path 12B which communicate with the opening portion 5A by means of paper guides 11A, 11B and 11C are formed. Guide selectors 13 are disposed in the vicinity of the branch point of the first and second transfer paths 12A and 12B, and pivot about a rod disposed at the proximal ends thereof. The proximal ends of the guide selectors are disposed near the branch point, while the distal ends are sapced apart therefrom. More specifically, as shown in FIG. 3, the guide selectors 13 are mounted on a guide selector rod 13A which is then connected to a plunger 13D of a guide selector solenoid 13C through a crank lever 13B. The plunger 13D is then biased upon in FIG. 3 by a biasing member 13E. When the guide selector solenoid 13C is deenergized, the guide selectors 13 are kept in the position shown in FIG. 2 to select the first transfer path 12A. However, when the guide selector solenoid 13C is energized, the guide selectors 13 are pivoted counterclockwise from the position shown in FIG. 2 to select the second transfer path 12B.

A first paper transfer section 15 is arranged to guide the copied paper sheet transferred into the first transfer path 12A to a nonsorting/storage section. The first paper transfer section 15 comprises, for example, a pair of nonsort rollers 16 which clamp and guide the paper sheet transferred along the first transfer path 12A. A nonsort tray 17 extending outward from the side frame 5 is arranged as the nonsorting/storing section to store the copied paper sheet discharged by the nonsort rollers 16. A second paper transfer section 18 is connected to the second transfer path 12B to guide the copied paper sheet transferred along the second transfer path 12B. In the secnd paper transfer section 18, a pair of idler wheels 19 are disposed in the vicinity of the second transfer path 12B, and a pair of drive wheels 20 are disposed to respectively oppose the idler wheels 19. Two endless transfer belts 21A and 21B are respectively looped between one idler wheel 19 and its corresponding drive wheel 20 and between the other idler wheel 19 and its corresponding drive wheel 20. The transfer belts 21A and 21B have a number of aspiration holes 21*a* and are spaced apart from each other. As shown in FIG. 2, an aspiration fan 22 is arranged at the rear surface of the base plate 4. The aspiration fan 22, through the aspiration holes 21*a*, draws the paper sheet toward and brings it into tight contact with the transfer belts 21A and 21B. As shown in FIG. 3, a paper transfer/drive mechanism 24 is disposed to extend through the base plate 4 and the side frame 5 so as to drive the first paper transfer section 15 and the second paper transfer section 18. The paper transfer/drive section 24 alternately drives the first and second paper transfer sections 15 and 18. The paper transfer/drive section 24 comprises: a reversible motor (transfer motor) 25; a first one-way clutch section 27 for transmitting the rotational force of the transfer motor 25 in one direction to the first paper transfer section 15; and a second one-way clutch section 28 for transmitting the rotational force of the transfer motor 25 in the other direction to the second paper transfer section 18. The first one-way clutch section 27 comprises a first spur gear 31 for transmitting the rotational force through a pinion gear 30 mounted on the shaft of the transfer motor 25, and a first one-way clutch 32 disposed between the first spur gear 31 and a shaft 16*a* of the nonsort rollers 16. When the transfer motor 25 is rotated counterclockwise in FIG. 3, the first one-way clutch 32 transmits the rotational force to the nonsort rollers 16 (in fact, to the lower rollers shown in FIG. 3). The second one-way clutch section 28 comprises: an idler gear 33 for transmitting the rotational force through the pinion gear 30; a second spur gear 34 meshing with the idler gear 33; a timing gear 35; a driving shaft 36 rotated together with the timing gear 35; a second one-way clutch 37 disposed between the driving shaft 36 and the second spur gear 34; a timing gear 38 rotated together with a shaft 20*a* of the drive wheels 20; and a timing belt 39 looped between the timing gears 35 and 38. When the transfer motor 25 is rotated clockwise in FIG. 3, the second one-way clutch 37 transmits the rotational force to the drive wheel 20. In the paper transfer/drive mechanism 24, in the nonsort mode, the nonsort rollers 16 (the lower rollers 16 shown in FIG. 3) are rotated clockwise to convey the paper sheet upward by rotating the transfer motor 25 counterclockwise in FIG. 3. However, in the sort mode, the motor 25 is rotated clockwise to rotate the drive wheel 20 in the clockwise direction, thereby conveying the paper sheet downward. As a result, even when a paper jam occurs in the second paper transfer section 18 or in a sorting/storing section 40 (to be described later), the first paper transfer section 15 can still be driven on its own, thereby preventing secondary paper jamming and damage to the apparatus. In this manner, nonsort mode operation can be performed. Especially when urgent copying is required, such requirements can be sufficiently satisfied. The paper transfer/drive section 24 need not be limited to the arrangement described above. For example, independent drive sections may be arranged for the respective paper transfer sections 15 and 18. Furthermore, each one-way clutch may be replaced with an electromagnetic clutch and a ratchet wheel.

Figure 4:
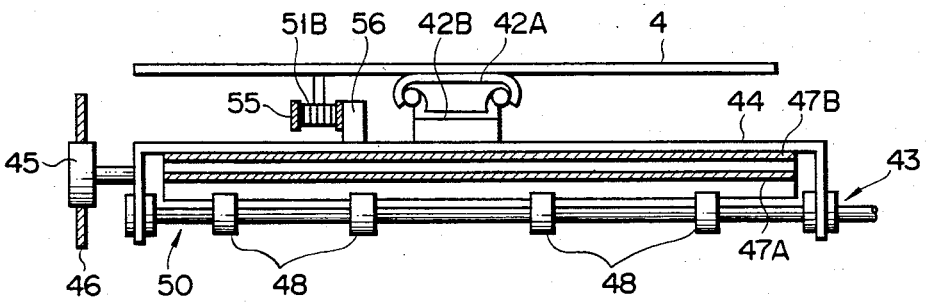
FIG. 4 is a sectional view of a carriage of the apparatus shown in FIG. 1, taken along a transverse plane thereof.

The sorting/storing section (to be referred to as a sort section hereinafter) 40 will be described wherein the copied paper sheet transferred by the second paper transfer section 18 is sorted and stored. In the sort section 40, a plurality of bins 41A through 41J are disposed on the frame cover 6 so as to extend outward therefrom at equal intervals. A linear guide rail 42A is disposed on the base plate 4 alongside and between the transfer belts 21A and 21B. A linear motion block 42B is slidably fitted in the linear guide rail 42A. A guide section 43 is mounted on the linear guide block 42B to guide the copied paper sheet transferred by the transfer belts 21A and 21B to a desired bin. It is noted that the bins 41A through 41J are aligned below the nonsort tray 17, as shown in FIGS. 1 and 2, so that both nonsorted and sorted paper sheets can be stacked at one general location, thereby improving the efficiency of sorting. In the guide section 43, a substantially U-shaped frame 44 is mounted on the linear motion block 42B as shown in FIGS. 3 and 4. A guide roller 45 is mounted at the left end (FIG. 3) of the frame 44 to prevent transverse vibration of the frame 44. An elongated hole 46A is formed in a side guide 46 which is mounted on the base plate 4. Guide members such as an upper guide 47A and a lower guide 47B are mounted on the frame 44 to guide the paper sheet transferred by the transfer belts 21A and 21B in the direction of the bins 41A through 41J. Bin rollers 48 are in contact with the lower guide 47B to be rotatable therewith so as to feed the transferred paper sheet in the forward direction. The upper bin rollers 48 are driven counterclockwise in FIG. 3 by a drive gear 49A, a pinion gear 49B meshing with the drive gear 49A, and a bin roller motor 49C for driving the pinion gear 49B. The bin rollers 48 feed the paper sheet at a higher speed than do the transfer belts 21A and 21B, so that the trailing edge of the paper sheet is not stopped before reaching the bins. Since the transfer belts 21A and 21B are fitted against the upper end of the lower guide 47B, as shown in FIG. 3, the upper end thereof separates the transferred paper sheet from the transfer belts 21A and 21B and smoothly guides it. A carriage drive section 51 is disposed on the base plate 4 to vertically move a carriage 50 (general name for an assembly of the frame 44, the upper and lower guides 47A and 47B, the bin rollers 48 and the bin roller motor 49C for driving the bin rollers 48) to a desired bin position along the transfer belts 21A and 21B.

Figure 5:
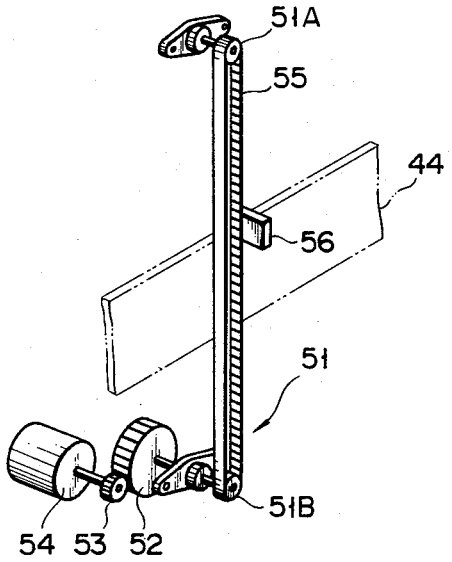
FIG. 5 is a schematic perspective view of a carriage drive mechanism of the apparatus shown in FIG. 1.
Figure 6:
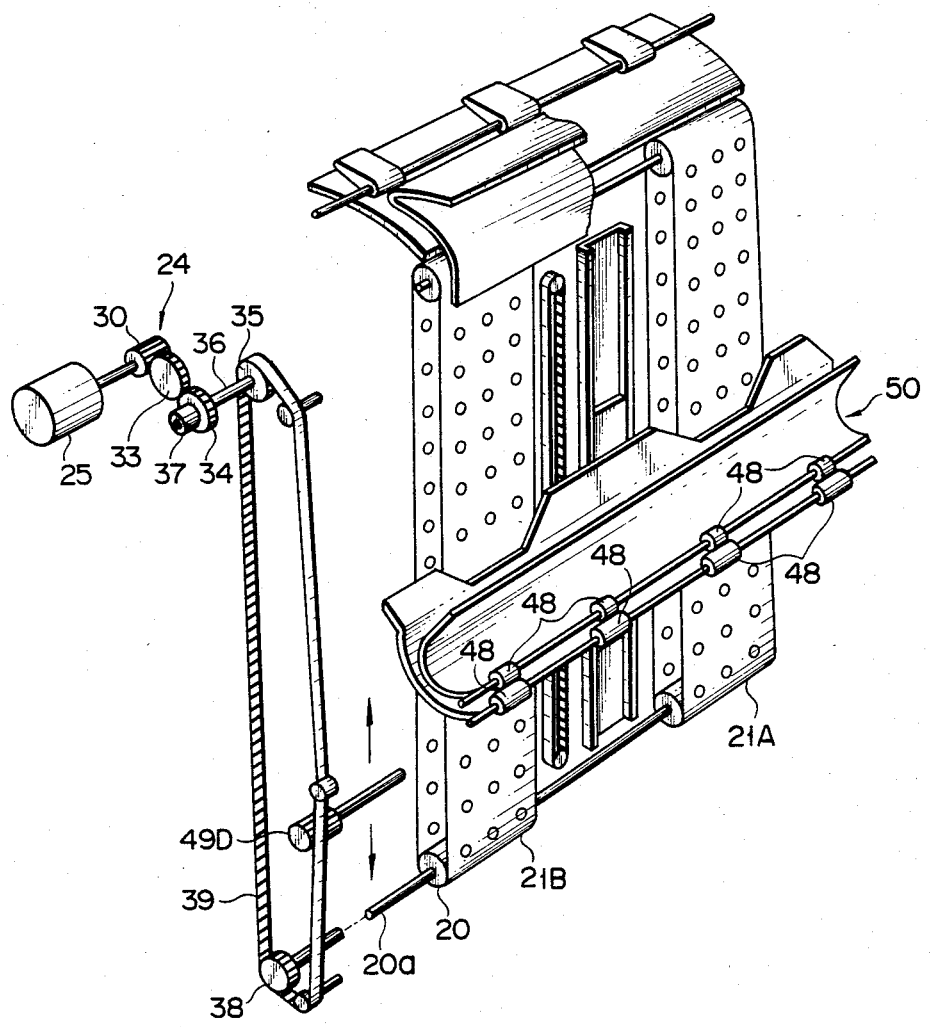
FIG. 6 is a perspective view showing a transfer driving means, a bin roller, and related mechanisms of the apparatus shown in FIG. 1.

As shown in FIGS. 3 and 5, the carriage drive section 51 comprises: an idler gear 51A and a drive gear 51B which are transversely disposed next to the linear guide rail 42A and which are rotatable; a spur gear 52 which is rotated together with the drive gear 51B; a pinion gear 53 meshed with the spur gear 52; a stepping motor (to be also referred to as a carriage motor hereinafter) 54 having a motor shaft on which the pinion gear 53 is mounted; a timing belt 55 looped between the idler gear 51A and the drive gear 51B; and a connecting member 56 for connecting the timing belt 55 and the frame 44. The carriage drive section 51 is thus so arranged as to move the carriage 50 to a desired bin position by driving the carriage motor 54 by a predetermined number of steps. In the above embodiment, the guide section 43 is arranged such that the carriage 50 is moved with respect to the bins 41A to 41J fixed on the frame cover 6. However, it is only necessary that the guide members 47A and 47B be moved relative to the bins 41A through 41J so as to guide the transferred paper sheet from the second paper transfer section 18 to a desired bin. Therefore, the bins may be moved instead of the guide members 47A and 47B. Furthermore, in the above embodiment, the bin rollers 48 are driven by the bin roller motor 49C. However, as shown in FIG. 6, a gear 49D which meshes with the timing belt 39 of the transfer belts 21A and 21B may be rotated together with the lower (FIG. 5) bin rollers 48. In this case, the driving force of the paper transfer/drive section 24 is used.

A carriage discharge switch (to be referred to as a CRG discharge switch hereinafter) 60 is arranged at the carriage 50 so as to detect a paper sheet fed through the bin rollers 48. The CRG discharge switch 60 detects paper jamming, drive timing of the carriage, and so on (to be described in detail later) in a transfer path between a copying machine discharge switch (to be referred to as a COP discharge switch hereinafter) 61 arranged in the discharge section 3 of the copying machine main body 2 and the CRG discharge switch 60. An initial switch 62 which contacts the upper guide 47A is disposed at the upper end portion of the linear guide rail 42A. The initial switch 62 is used to set the carriage 50 at its initial position opposing the bin 41A (to be described in detail later). As shown in FIG. 2, a door switch 63 is arranged on the side frame 5 to detect whether the frame cover 6 is open/closed.

The power source of the sorter 1 is supplied from the main unit of the copying machine main body 2. For example, power is supplied to the sorter 1 by inserting a plug (not shown) of the sorter into a connector (not shown) arranged at the main unit of the copying machine main body 2.

Figure 7:
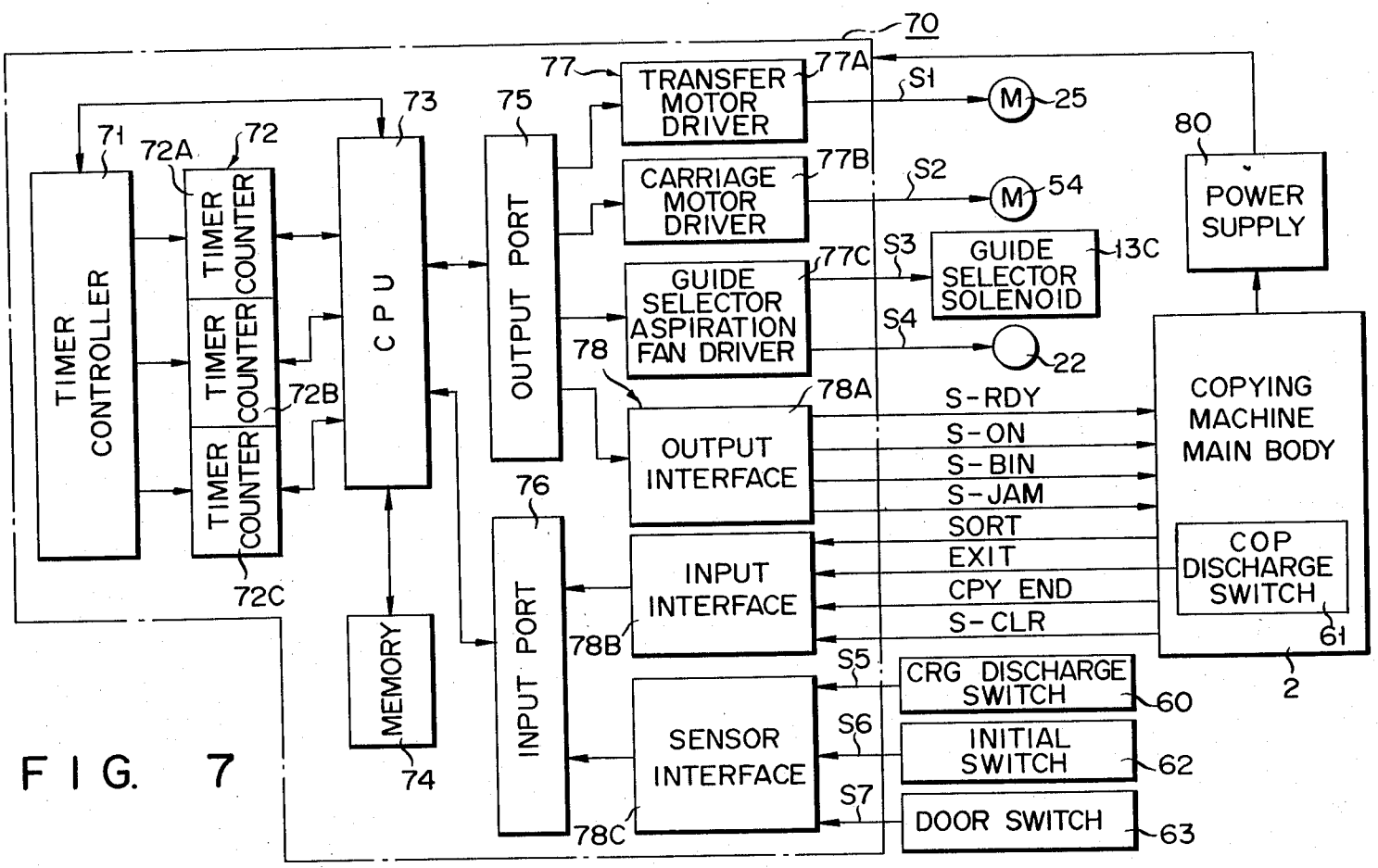
FIG. 7 is a block diagram of a control section of the apparatus shown in FIG. 1.

The arrangement of a control section 70 of the sorter 1 according to the present invention will be described with reference to FIG. 7. The control section 70 is designated by an area surrounded by the alternate long and short dash line. FIG. 7 also illustrates other elements such as sorter mechanisms and external units. The transfer motor 25, the carriage motor 54, the guide selector solenoid 13C, the aspiration fan 22, the CRG discharge switch 60, the initial switch 62 and the door switch 63 are illustrated as mechanisms related to the sorter 1. The copying machine main body 2, the COP discharge switch 61 thereof, and a power source 80 are illustrated as the external units. In fact, the copying machine main body 2 has an operation panel (not shown) which comprises a preset number key, a copy start button, a sorting start button, and a display section including a jam indicator, a copy number display and a sort number display. The transfer motor 25 and the carriage motor 54 comprise phase switching type stepping motors, respectively.

Before the control section 70 is described, the stepping motor used in the present invention will be described.

Figure 8A:
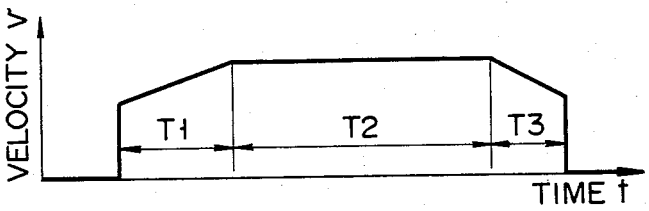
FIGS. 8A through 8C are graphs for explaining the velocity of a stepping motor as a function of time.
Figure 8B:
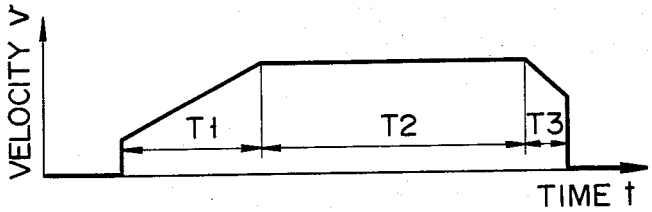
Figure 8C:
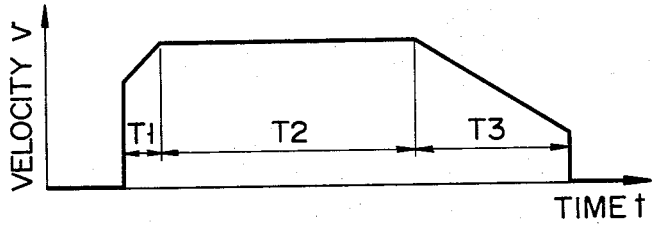

As may be known, the rotational frequency of a stepping motor can be accurately controlled by controlling the number of excitation pulses supplied thereto. When such a stepping motor is used to control the carriage 50, the displacement of the carriage 50 can be controlled by counting the number of excitation pulses, thereby performing easy alignment with the bins. Furthermore, since the velocity of the stepping motor can be controlled by changing the frequency of the excitation pulses, an object to be moved can be first moved at a low velocity, then at a high velocity and finally at a low velocity again. In this manner, the object can be smoothly moved for precise alignment. In the above embodiment, the transfer motor 25 and the carriage motor 54 are driven and controlled in the same manner as described above. However, the operating conditions of these motors slightly differ, so that the actual control operations differ slightly. The transfer motor 25 is driven at a constant velocity period T2 and at reduced velocity periods T1 and T3, as shown in FIG. 8A. The reduced velocity periods T1 and T3 have substantially the same slope. However, when the carriage 50 is moved upward, the carriage motor 54 is subjected to a reverse rotational force by the weight of the carriage 50. However, when the carriage is moved downward, the carriage motor 54 is subjected to a forward rotational force. Therefore, the carriage motor 54 is driven in the two ways shown in FIGS. 8B and 8C. FIG. 8B illustrates a case in which the carriage is moved upward; the carriage motor is first driven at a low velocity and its rotational velocity reaches a constant velocity after a relatively long period of time as compared with the case of the transfer motor 25. The carriage motor 54 is then stopped within a short period of time since the weight of the carriage 50 serves as a brake. FIG. 8C illustrates a case in which the carriage 50 is moved downward. At the beginning, the carriage motor 54 can drive the carriage 50 downward using the weight thereof, so that the carriage motor 54 is driven at a high velocity for a short period of time. However, at the end, the velocity of the carriage motor 54 is gradually reduced over a long period of time since the inertia force is applied to the carriage motor 54.

The above control operations are performed by commands from a timer counter controller 71 under the control of a microcomputer 73 (to be described in detail later). When the frequency of the excitation pulses exceeds a self starting frequency, the stepping motor is stepped out to stop without any mechanical stress. When the self starting frequency is obtained again, the stepping moter starts rotation again. As previously described in the above embodiment, when the initial switch 62 is arranged at the upper end of the travel range of the carriage 50, the initial switch 62 serves as a stopper to step out the stepping motor. As a result, the stepping motor is automatically stopped. As a result, the initial position of the carriage 50, that is, the carriage position obtained when the initial switch 62 is turned on and the carriage motor 54 is driven in the reverse direction by several switches, is determined to correspond to the uppermost bin 41A. However, the initial position may be set in the following manner; using the small detent torque of the stepping motor in the nonexcitation period, the carriage 50 is moved downward by its self weight and is stopped by abutment against a stopper (a stopper 19' indicated by the alternate long and two short dash line in the vicinity of the door switch 63 in FIG. 2), thereby setting the initial position of the carriage 50.

Figure 9:
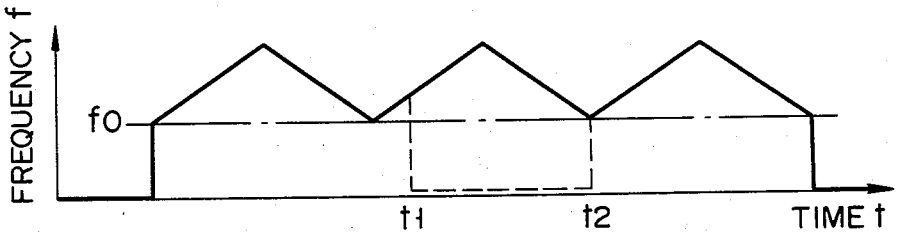
FIG. 9 is a graph for explaining the frequency of the stepping motor as a function of time.

In the above embodiment, the carriage 50 which has been moved to the lower position when the sorter 1 is used, is moved upward to turn on the initial switch 62. However, the stepping motor is stepped out when paper jamming or the like occurs. It is possible that the stepping motor may not start, even after such a problem is resolved. In order to solve this problem, the drive frequency of the stepping motor is alternately changed between high and low velocities. Even if a step-out occurs at time tl (FIG. 9) while the carriage 50 is in motion, the stepping motor 54 is started at time t2 when the actual frequency of the motor 54 reaches the self starting frequency f0.

The control section 70 comprises the timer counter controller 71, a timer counter section 72, the microcomputer (CPU) 73, a memory 74, an output port 75, an input port 76, a driver section 77, and an interface section 78.

The timer counter section 72 comprises a transfer motor timer counter 72A, a carriage motor timer counter 72B, and a timer counter 72C used as a general timer means for determining the timings of the component parts and for detecting a paper jam. The driver section 77 comprises a transfer motor driver 77A, a carriage motor driver 77B, and a guide selector/aspiration fan driver 77C. The interface section 78 comprises an output interface 78A, an input interface 78B and a sensor interface 78C. The memory 74 includes a ROM which stores drive data for the stepping motors (the transfer motor 25 and the carriage motor 54), timing data for detecting a paper jam, time data, and program data which indicates the processing steps of the microcomputer 73. The memory 74 also includes a RAM, the pin position data of which is updated corresponding to the displacement of the carriage 50. A 4-bit microcomputer TA4004 manufactured by Toshiba Corporation may be used as the microcomputer 73.

An example of storage data of the memory 74 will be described in detail. Time data which indicates the displacement of the carriage 50 corresponding to the distance between the bins is stored as stepping motor drive data. In this case, it is, of course, the velocity control data shown in FIGS. 8 and 9 that is stored. Furthermore, 4-bit data which indicates the bin position is also stored in the memory 74. Data which indicates the current bin position is sequentially selected to correspond to a displacement of the stepping motor after the initial switch 62 is turned on and the initial position of the carriage 50 is set. Furthermore, reference data for jam detection is stored in the memory 74. More particularly, time data is stored which indicates a time interval taken for the paper sheet to pass the COP discharge switch 61 of the copying machine 2 and reach the CRG discharge switch 60 arranged at the carriage 50 on the side of the sorter 1. In particular, in the above embodiment, the time data varies in accordance with the position of carriage 50, so that a plurality of time data are stored corresponding to various amounts of displacement of the carriage 50 along the bins.

The read start timing of the time data corresponds to the generation of a discharge signal EXIT.

The signals which are exchanged between the control section 70 and the respective mechanisms will be described in detail. A signal S1 form the transfer motor driver 77A drives the transfer motor 25 clockwise so as to drive the transfer belts 21A and 21B in the sort mode. However, the signal S1 also drives the drive motor 25 counterclockwise so as to drive the nonsort rollers 16. A signal S2 from the carriage motor driver 77B is used to rotate the carriage motor 54 in the forward or reverse direction to move the carriage 50. A signal S3 as one of the output signals from the guide selector/aspiration fan driver 77C deenergizes the guide selector solenoid 13C to switch and set the guide selector 13 to the nonsort mode. When the guide selector solenoid 13C is energized, the guide selector 13 is set in the sort mode. A signal S4 as the other one of the output signals from the guide selector/aspiration fan driver 77C is used to drive the aspiration fan 22. A signal S5 among signals S5 through S7 is supplied from the CRG discharge switch 60 to the sensor interface 78C when the the copied paper sheet on the carriage 50 passes through the bin rollers 48. The signal S5 is used for jam detection. The signal S6 from the initial switch 62 is used to set the initial position of the carriage 50 when the carriage 50 reaches the initial switch 62. The signal S7 from the door switch 63 causes all the motors to stop when the sorter cover is opened and invalidates the use of the sort and copy keys. The signal S7 then serves as a signal to reset a sorter jam signal S-JAM produced in the sorter 1.

Various signals will now be described which are exchanged between the control section 70 and the copying machine main body 2. A sorter ready signal S-RDY, a sorter ON signal S-ON, a sorter bin position signal S-BIN, and the sorter jam signal S-JAM are produced by the output interface 78A and are supplied to the copying machine main body 2. The sorter ready signal S-RDY causes corresponding lamps to be OFF at the panel section of the copying machine main body 2 while the carriage 50 is being moved to the initial section, while the sort/nonsort selector operation is being performed, and if the sorter cover is open. Otherwise, the sorter ready signal S-RDY causes the corresponding lamps to be ON. The sorter ON signal S-ON indicates whether or not the sorter 1 is mounted on the copying machine main body 2 in accordance with the connection/disconnection of the power source connector. The sorter bin position signal S-BIN indicates the bin position to which the carriage 50 corresponds. The sorter bin position signal S-BIN causes a value to be displayed at a display section (not shown) of the panel section of the copying machine main body 2 in accordance with the 4-bit signal. Therefore, any bin wherein a paper jam occurs can be easily detected. The sorter jam signal S-JAM is produced when a paper jam occurs in the sorter 1. The sorter jam signal S-JAM also serves to indicate an "improper sort" when the number of types of paper sheets to be sorted exceeds the number of bins.

A sort signal SORT, a discharge signal EXIT, a copy end signal CPYEND, and a sorter clear signal S-CLR are supplied from the copying machine main body 2 to the input interface 78B. The sort signal SORT indicates the sorting condition of the sorter 1. The sorter 1 is started in response to the sort signal SORT. The discharge signal EXIT is produced by the COP discharge switch 61 in the copying machine main body 2. The discharge signal EXIT goes high until the COP discharge switch 61 detects the trailing edge of the copied paper sheet after the switch 61 has detected the leading edge thereof. The discharge signal EXIT is thus used as a reference signal for jam detection. The copy end signal CPYEND is produced when the final paper sheet is copied. When this signal is produced in the sort mode, the sorter 1 delivers this paper sheet to a predetermined bin and is stopped. The sorter clear signal S-CLR is produced simultaneously when power is ON. In response to the signal S-CLR, the control section 70 causes the carriage 50 to move to the initial position at which the initial switch is turned on.

Figure 10:
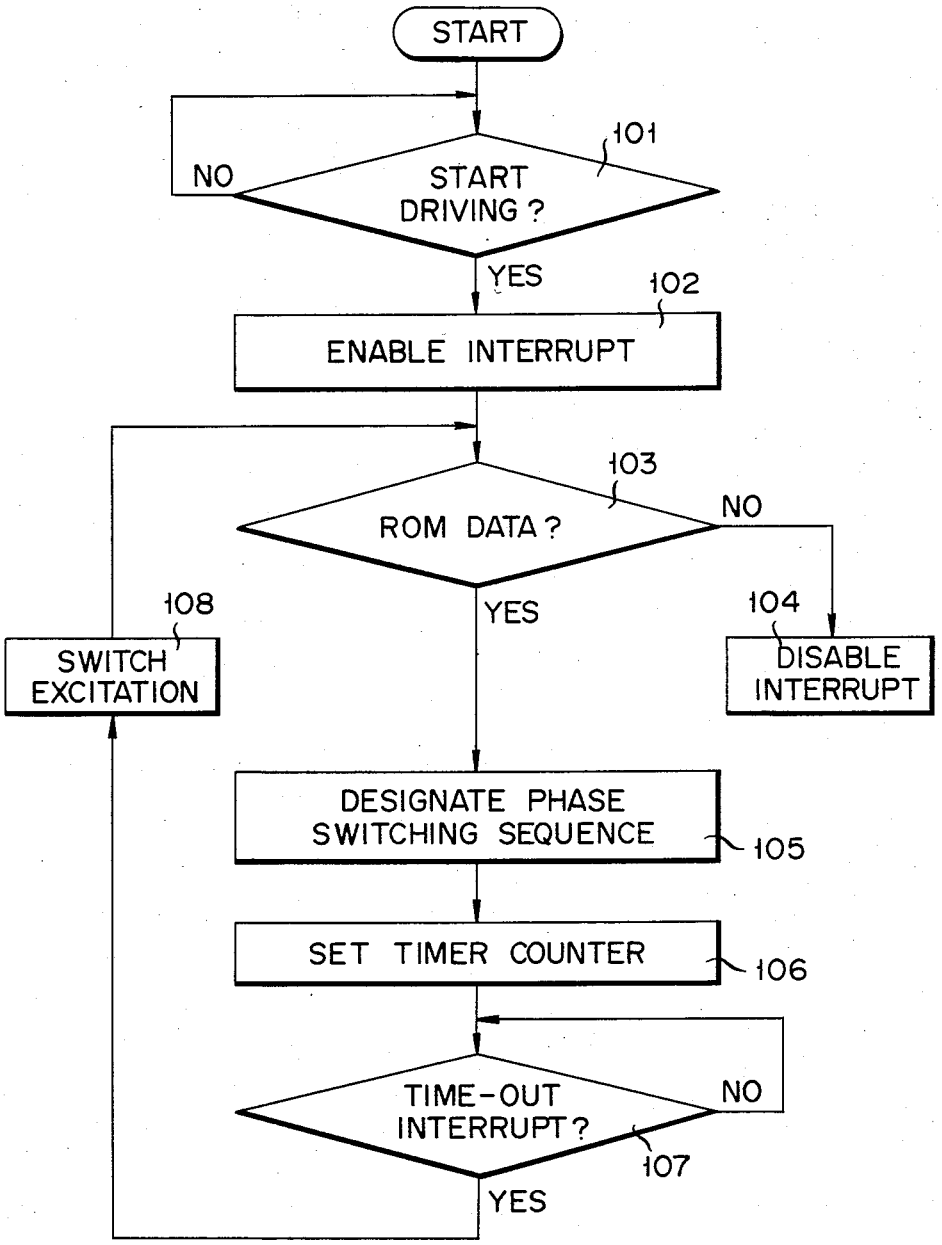
FIGS. 10 is a flow chart for explaining the control method of the drive sources.
Figure 11A:
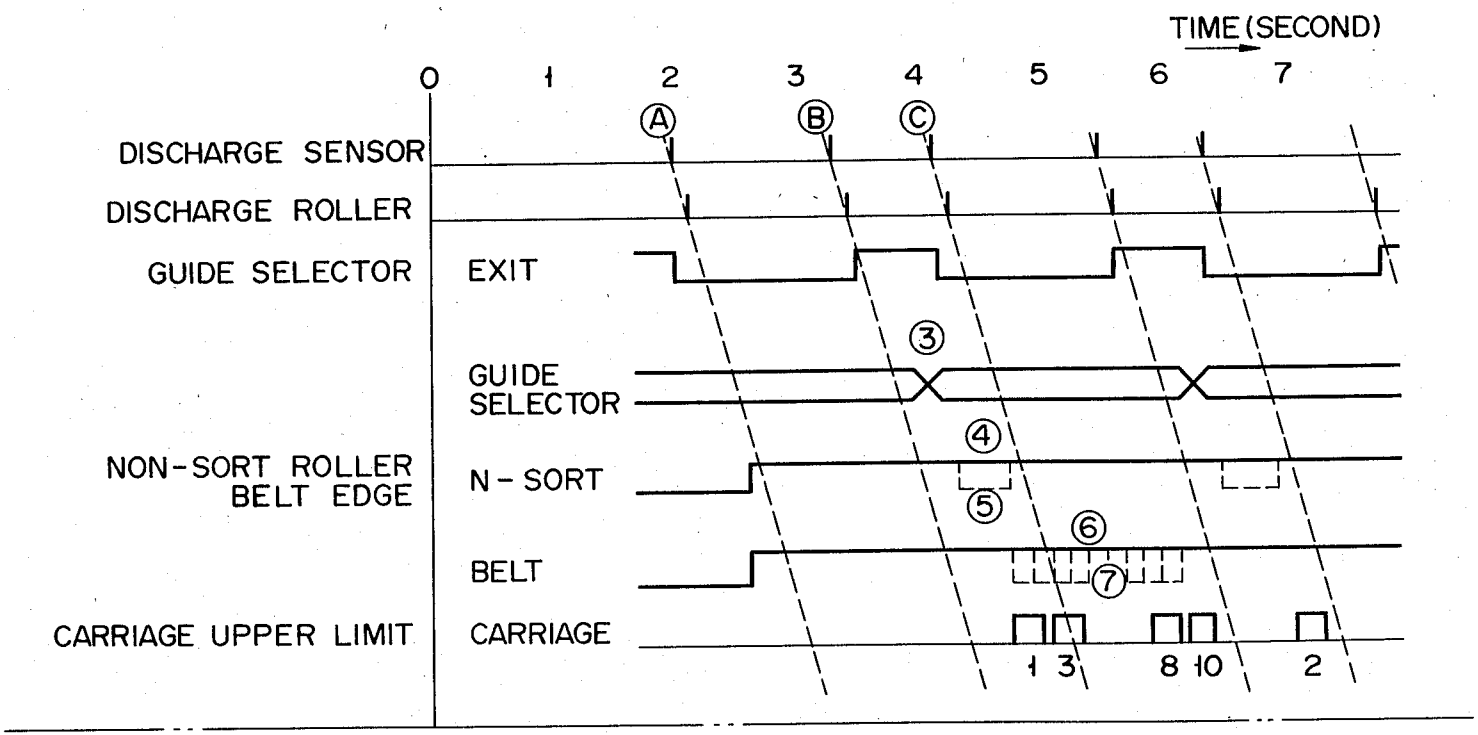
FIGS. 11A and 11B are timing charts for explaining the mode of operation of the apparatus shown in FIG. 1.
Figure 11B:
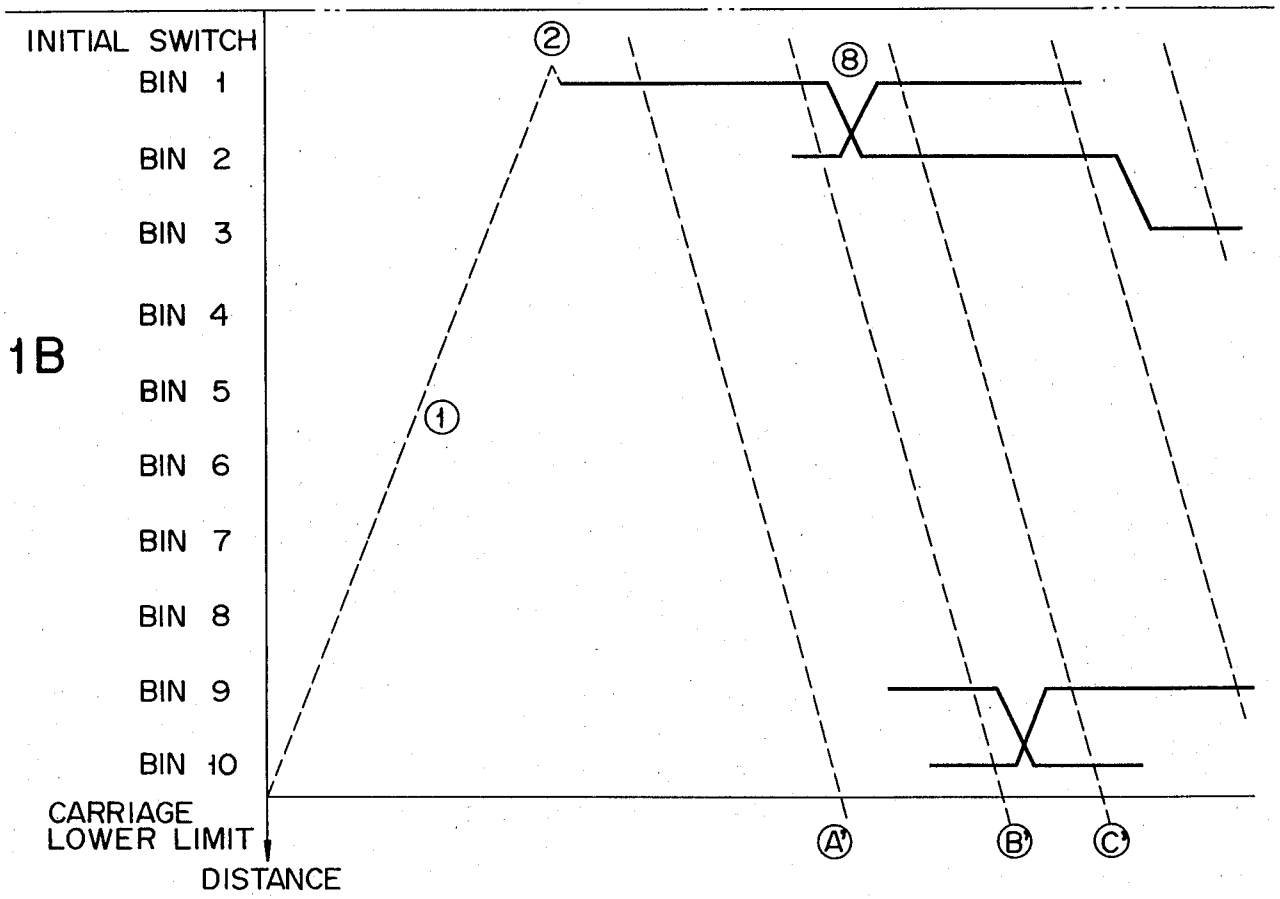
Figure 12A:
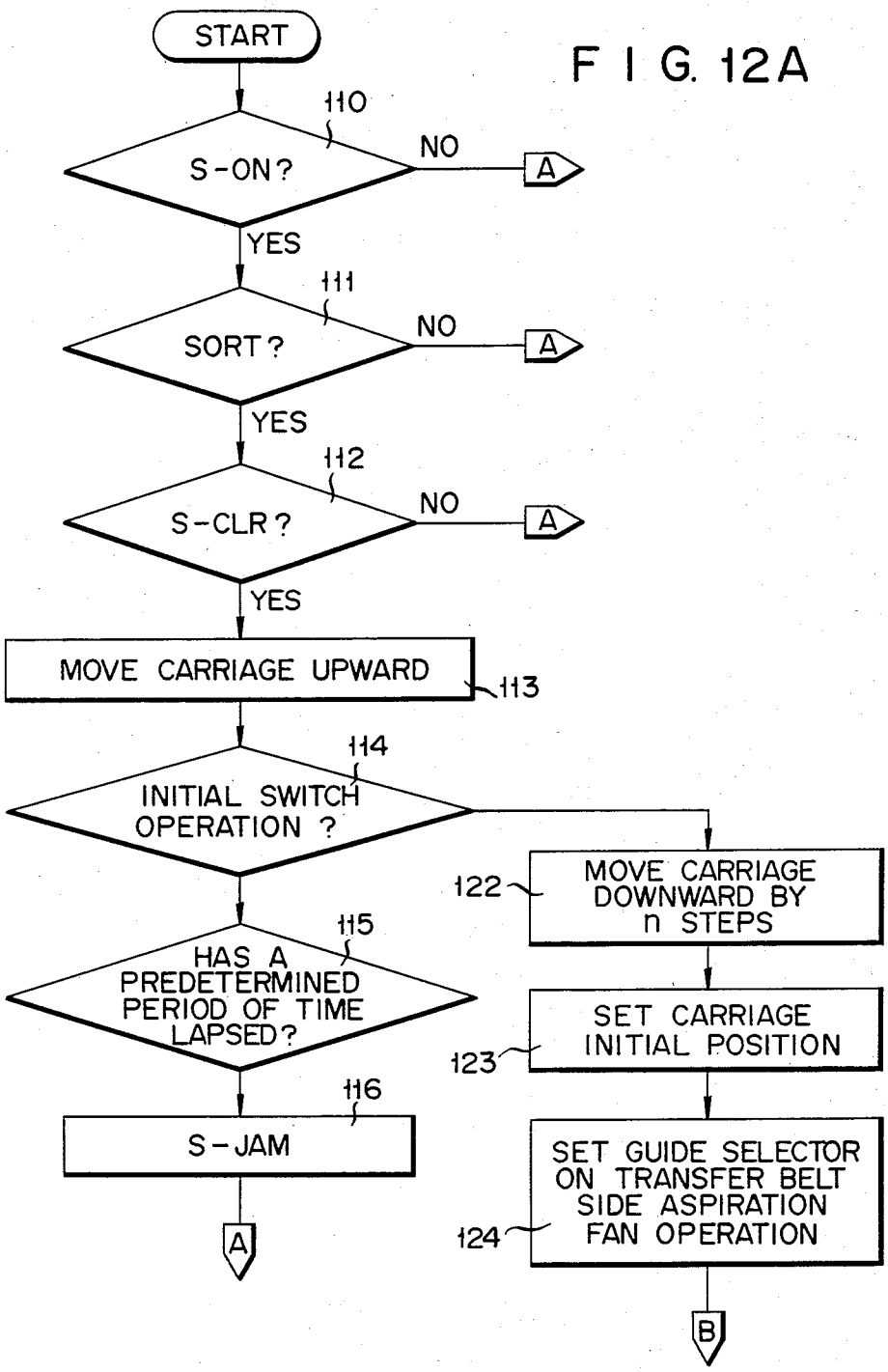
FIGS. 12A through FIG. 12C are flow charts for explaining the mode of operation of the apparatus shown in FIG. 1.
Figure 12B:
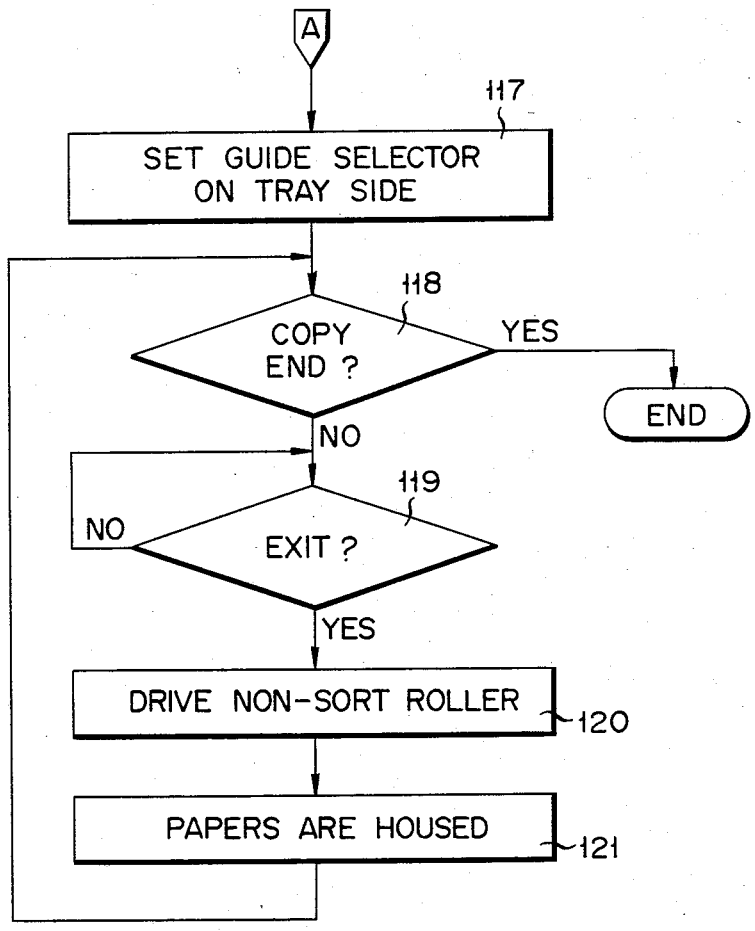
Figure 12C:
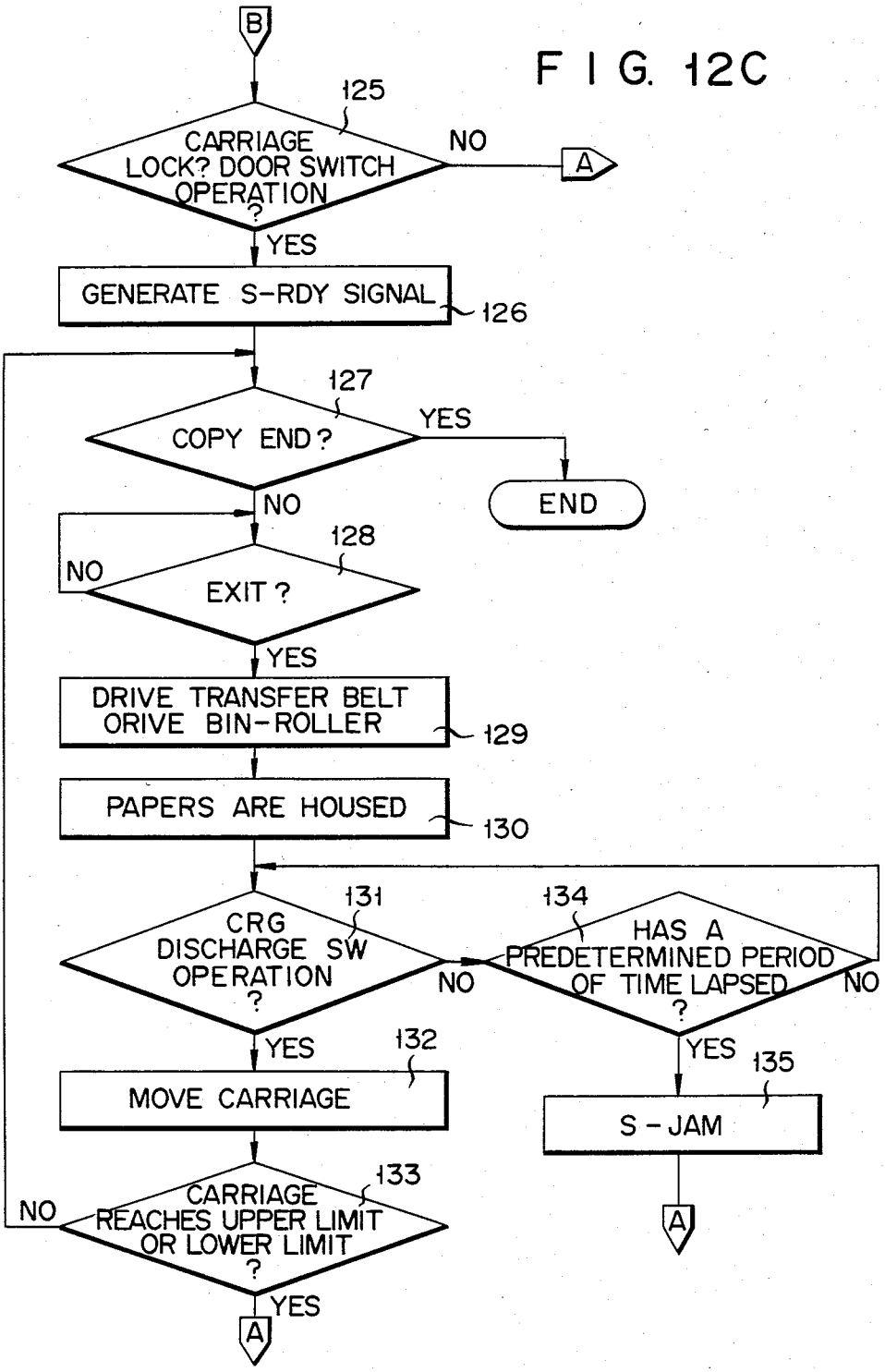

The mode of operation of the sorter 1 of the above embodiment will be described hereinafter. Before the overall operation of the sorter 1 is described, a method for driving and controlling the stepping motors will be described with reference to a flow chart in FIG. 10. The microcomputer (CPU) 73 determines in step 101 whether or not the motors have started driving. If YES in step 101, an interrupt mode is enabled in step 102. It is determined in step 103 whether or not ROM data is present. If YES in step 103, motor direction designation data is read out from the memory 74 in step 105 to designate the phase switching sequence through the output port 75 and the carriage motor driver 77B. In step 106, time data required for movement of the carriage 50 relative to the bins of the sorter 1 is read out from the ROM of the memory 74 and is set in the carriage motor timer counter 72B. The timer counter 72B counts down the time data in response to the clock signal from the timer counter controller 71. If the count of the timer counter 72B reaches "0", that is, the time is out in step 107, the count "0" is signalled to the CPU 73. The CPU 73 then supplies a switch excitation (excitation phase switching) signal to the carriage motor driver 77B in step 108, thereby rotating the carriage motor by one step. The routine returns to step 103 again. If data is present, data is read out from the ROM to repeat rotation of the motors by the number of predetermined steps. It is noted that the velocity control data is read out from the ROM and is fetched in the CPU 73 to control the velocity of the motors in accordance with the velocity characteristics shown in FIGS. 8A through 8C and FIG. 9. The carriage 50 is set at the initial position in the following manner. When the sorter clear signal S-CLR is produced immediately after power is ON, the CPU 73 sequentially fetches data from the ROM of the memory 74 to drive the carriage motor 54 in a stepwise manner. When the carriage 50 is moved upward and then abuts against the initial switch 62, the initial switch ON signal S6 is supplied from the initial switch 62 to the CPU 73. In response to the signal S6, the CPU 73 controls the carriage motor 54 to temporarily stop it. Thereafter, the CPU 73 fetches carriage motor reverse rotation data from the ROM to rotate the carriage motor 54 by one step (or several steps) in the reverse rotation. Thus, the carriage 50 is positioned at the uppermost bin 41A. This position of the carriage 50 is the initial position. When the initial position of the carriage 50 is thus set, the timer counters 72A through 72C are set in the clear condition. At the same time, data which indicates the first bin 41A is selected from the 4-bit data which indicate the bin positions and which are stored in the memory 74. A value is displayed at the panel section of the copying machine main body 2 in accordance with the data which indicates the first bin 41A. Predetermined counting is performed by the timer counter 72B every time the carriage 50 is moved. The position of the bin which is currently used can be known by the number of completed timer count operations. Furthermore, the bin number displayed at the panel section is updated.

The overall mode of operation of the sorter 1 will be described with reference to timing charts in FIGS. 11A and 11B and FIGS. 12A through 12C.

Nonsort Operation

When power is supplied to the sorter 1 in step 110, it is determined whether or not the sorter 1 is mounted on the copying machine main body 2, in accordance with the connection/disconnection of the connector. When the sorter ON signal S-ON is produced, the routine advances to step 111. It is then determined in step 111 whether the sort or nonsort mode is set in accordance with the presence or absence of the sort signal SORT from the sort key at the copying machine main body 2.

It is determined in step 112 whether or not the sorter clear signal S-CLR is produced from the copying machine main body 2. If NO in steps 110, 111 and 112, the nonsort routine is executed. More particularly, in step 117, since the sorter clear signal S-CLR is not produced, the outputs from the guide selector/aspiration fan driver 77C are disabled, so that the guide selector solenoid 13C is not energized. The guide selector 13 is set such that the paper sheet is transferred to the nonsort tray 17. It is then determined in step 118 whether or not the copy end signal CPYEND is produced from the copying machine main body 2. If NO in step 118, the copied paper sheet reaches the COP discharge switch 61 after the operator depresses a copy start key (not shown). In step 119, the COP discharge switch 61 is turned on, and the discharge signal EXIT is produced therefrom. In step 120, after a predetermined time interval has elapsed (a time interval during which the copied paper sheet is moved from the discharge rollers of the copying machine main body to the sorter discharge rollers), the transfer motor 25 is rotated counterclockwise. In step 121, the nonsort rollers 16 are then driven to guide the paper sheet to the nonsort tray 17. In this condition, the rotational velocity of the nonsort rollers 16 is the same as or slightly faster than the discharge velocity at the copying machine main body, thus smoothly transferring the copied paper sheet. When the discharge signal EXIT goes low, the transfer motor 25 is stopped for a predetermined time interval. However, when the discharge signal EXIT goes high during the predetermined time interval, the transfer motor 25 continues to rotate. In this manner, when the nonsort operation is performed and the end copy signal COPYEND is produced from the copying machine main body 2, the final paper is discharged into the nonsort tray 17, and the nonsort operation is completed.

Sort Operation

When the operator mounts the sorter 1 on the copying machine main body 2 and presses the sort key, and when the sorter clear signal S-CLR is produced, the control section 70 in the sorter 1 controls the carriage 50 to set it in the initial position. In step 113, the carriage 50 is moved upward. In step 114, the carriage 50 is then stopped while the initial switch 62 is being turned on. In step 122, the carriage motor 54 is rotated by a few steps in the reverse direction. In step 123, the carriage 50 is set in the initial position corresponding to the uppermost bin 41A. In step 124, the guide selector 13 is switched to the side of the transfer belts 21A and 21B. At the same time, the aspiration fan 22 is also started. When the copy key is depressed immediately after the sorter key is depressed, carriage alignment is performed in a time interval during which the paper sheet is transferred in the copying machine main body 2. Therefore, waiting time is completely eliminated.

The CPU 73 in the control section 70 determines in step 125 whether or not the door switch 63, which indicates whether the sorter cover is open/closed, is turned on. Furthermore, it also determines whether or not the carriage 50 is located at the predetermined position in accordance with the operating condition of the carriage motor timer counter 72B. If it is determined that the door switch is ON and the carriage 50 is located at the predetermined position, the routine advances to step 126. In step 126, the sorter ready signal S-RDY is produced, thereby signalling the copying operation and the sort ready condition. Thereafter, it is determined in step 127 whether or not the copy end signal CPYEND is produced from the copying machine main body 2. If NO in step 127, the copy discharge switch 61 in the copying machine main body 2 produces in step 128 the discharge signal EXIT when the just-copied paper sheet passes the copy discharge switch 61. The discharge signal EXIT is then supplied to the control section 70 of the sorter 1. In step 129, the control section 70 controls to drive the transfer motor 25 when a predetermined time interval has elapsed. As a result, the transfer belts 21A and 21B are moved, and at the same time, the bin rollers 48 disposed on the carriage 50 are driven through the bin roller motor 49C. In this case, the bin rollers 48 are driven at a speed faster than that of the transfer belts. The copied paper sheet fed from the copying machine main body 2 is aspirated onto the transfer belts 21A and 21B and is transferred downward. In step 130, when the paper sheet reaches the paper guide section of the carriage 50 located corresponding to the uppermost bin 41A, the paper sheet is removed from the transfer belt and is guided to the side of the bin rollers 48. Furthermore, the paper sheet is delivered or housed in the uppermost bin 41A by the bin rollers 48. Since the bin rollers are driven faster than the transfer belts, the paper sheet is smoothly stored or housed. In step 131, the operating condition of the CRG discharge switch 60 is checked to know whether or not a paper jam has occurred. In step 134, the paper transfer time, data which is stored in the ROM, is compared with the time until the CRG discharge switch 60 is turned on. If the CRG discharge switch 60 is not turned on even after a predetermined time interval has elapsed, display of the sorter jam signal S-JAM is performed in step 135. At the same time, the control section 70 determines that the sorting operation has resulted in "improper sorting", so that the sorting mode is switched to the nonsort mode without any interruption. As a result, the paper sheet is stored or housed in the nonsort tray 17. The jam status can be released only by opening the sorter cover (frame cover 6). When the operator opens the frame cover 6, all the motors are stopped. Furthermore, the sorter jam signal S-JAM is reset by the signal from the door switch 63 which is brought into contact with the frame cover 6. After the jam status is released, the operator simply closes the frame cover 6. In step 132, the carriage 50 is moved to the position corresponding to the uppermost bin 41A and is then moved to a position immediately before the bin position at which the frame cover 6 was opened. This can be achieved since the CPU 73 stores this bin position data and executes a command to move the carriage from the initial position to the corresponding bin position. It is noted that the copy start key is inoperative while the cover is open. The time interval until the paper sheet reaches the corresponding bin after the discharge signal EXIT is produced varies. However, the corresponding bin (which is currently used) is detected by the CPU 73, so that the time interval can be determined in accordance with the constantly corresponding reference time interval. It is determined in step 133 whether the carriage 50 is located at the upper or lower limit of its travel range. This is determined by the CPU which holds data of the current position of the carriage 50 whether or not any bin is present in the travel direction of the carriage. However, if the carriage position does not correspond to the upper and lower limits, the routine returns to step 127. The above operation is repeated to perform the sort operation in accordance with the number of document sets. For the next document, the carriage 50 is sequentially moved upward from the bin position at which previous sorting ended. When the copy end signal CPYEND is produced, the final paper sheet is stored or housed in the corresponding bin, and the sorting mode is terminated.

A case will be described wherein the number of types of documents to be sorted exceeds the number of bins. The sorter 1 has 10 bins. Assume that the operator wishes to sort 12 types of documents. Ten types of documents can be sorted in the first through tenth bins, respectively. However, the 11th and 12th types of documents cannot be sorted. More particularly, in the decision flow, the CPU 73 determines that the carriage 50 is located at one of the upper and lower limits, so that the 11th and 12th types of documents are stored or housed in the nonsort tray 17 in accordance with the nonsort mode.

In the above operation, when a new discharge signal EXIT is not produced even after a predetermined time interval has elapsed, the transfer belts 21A and 21B are stopped. The sorter 50 is located at the current position in the sort mode while the carriage motor 54 is energized. In this case, it is preferred that the excitation current be smaller than that in the driving condition or that the motor 54 is intermittently energized so as to decrease power consumption and heat. Furthermore, the aspiration fan 22 blows its exhaust air onto the carriage motor 54, thereby cooling the carriage motor 54.

The interrupt copying operation can be performed only in the nonsort mode. However, when the operator depresses the interrupt key in the sort mode, the control section 70 causes the copied paper sheet from the copying machine main body 2 to be stored or housed in the corresponding bin, and controls the carriage to move in the predetermined direction and the guide selector to be set to the nonsort side. The discharged paper sheet (the first copy sheet in the interrupt operation) is stored or housed in the nonsort tray 17. When the guide selector is reset to the transfer belt side after the interrupt copying operation is completed, the status immediately prior to the interrupt operation is set, so that sorting can be continuously performed.

What is claimed is:

1. A paper sorting/storing apparatus, comprising:

transfer direction selecting means for selectively switching a transfer direction of a paper sheet between first and second transfer directions;

first paper transferring means for transferring the paper sheet in the first transfer direction selected by said transfer direction selecting means;

second paper transferring means for transferring the paper sheet in the second transfer direction selected by said transfer direction selecting means;

nonsorting/storing means for storing the paper sheet transferred by said first paper transferring means;

sorting/storing means for sorting and storing the paper sheet transferred by said second paper transferring means; and paper transferring/driving means for stopping at least said second paper transferring means while said first paper transferring means is in motion, said paper transferring/driving means including, (a) a reversible drive source, (b) a first one-way clutch section for transmitting a rotational force of said drive source in one direction to said first paper transferring means; and (c) a second one-way clutch section for transmitting the rotational force of said drive source in the other direction to said second paper transferring means.

2. An apparatus according to claim 1, wherein said second paper transferring means comprises:

transfer belts which respectively comprise endless belts, said endless belts having a plurality of aspiration holes on transfer surfaces thereof and being looped to be rotatable; and an aspiration fan for aspirating the paper sheet through said aspiration holes of said transfer belts.

3. An apparatus according to claim 1, wherein said sorting/storing means comprises:

a plurality of bins for storing sorted paper sheets therein; and a guide member, movable relative to said plurality of bins, for guiding the paper sheet conveyed to said second paper transferring means to a desired bin.

* * * * *